United States Patent [19]

Prior

[11] 4,191,610

[45] Mar. 4, 1980

[54] UPGRADING WASTE PAPER BY TREATMENT WITH SULFITE WASTE LIQUOR

[76] Inventor: Eric S. Prior, Weideweg 1A, D-5166 Kreuzau-Untermaubach, Fed. Rep. of Germany

[21] Appl. No.: 938,792

[22] Filed: Sep. 1, 1978

Related U.S. Application Data

[63] Continuation of Ser. No. 740,318, Nov. 9, 1976, abandoned, which is a continuation of Ser. No. 566,284, Apr. 9, 1975, abandoned.

[51] Int. Cl.[2] ..... D21H 3/18

[52] U.S. Cl. ..... 162/147; 162/163; 162/164 R; 162/175; 162/184; 428/182

[58] Field of Search ..... 162/16, 163, 164 R, 162/184, 147; 260/124 R; 106/123 R, 123 LC; 71/25; 428/182, 535

[56] References Cited

U.S. PATENT DOCUMENTS

| | | | |
|---|---|---|---|
| 550,712 | 12/1895 | Ekman | 162/16 |
| 1,235,153 | 6/1917 | Hoeffner | 162/163 |
| 1,842,712 | 1/1932 | Bradley | 162/16 |
| 3,007,910 | 11/1961 | Adolphson et al. | 260/124 R |
| 3,007,910 | 11/1961 | Adolphson et al. | 260/124 R |
| 3,236,720 | 2/1966 | Tousignant et al. | 162/163 |
| 3,305,435 | 2/1967 | Williston et al. | 162/167 |
| 3,644,167 | 2/1972 | Mowry | 428/182 |
| 3,794,557 | 2/1974 | Harmon | 162/157 C |

FOREIGN PATENT DOCUMENTS

| | | | |
|---|---|---|---|
| 560515 | 7/1958 | Canada | 260/124 R |
| 47-17675 | 9/1972 | Japan | 260/124 R |

*Primary Examiner*—S. Leon Bashore
*Assistant Examiner*—William F. Smith
*Attorney, Agent, or Firm*—Bernard & Brown

[57] ABSTRACT

Fibrous materials are disclosed having incorporated therein upgraded waste sulphite liquor; the liquor is neutralized, e. g., with sodium borate, sodium aluminate, reacidified, if needed, with alum; the modified sulphite waste liquor of hardwoods as well as articles of manufacture of fibrous materials such as corrugated medium made of waste materials are diclosed; further, articles of manufacture thus modified include starch or sizing and are within the scope of the invention.

22 Claims, No Drawings

UPGRADING WASTE PAPER BY TREATMENT WITH SULFITE WASTE LIQUOR

This is a continuation of application Ser. No. 740,318, filed Nov. 9, 1976 now abandoned which is in turn a continuation, of application Ser. No. 566,284, filed Apr. 9, 1975 now abandoned.

This invention pertains to improving the utilization of waste materials, more particularly, this invention pertains to improving the strength characteristics of materials suitable for producing containers such as corrugated boxes ranging from virgin fiber to waste fiber and resinous materials which heretofore could not be employed for producing containers of acceptable properties. Moreover, this invention pertains to utilization of mixed waste material, old corrugated boxes, and corrugated clippings employed as a starting material for producing the containers. Additionally, this invention provides a means to improve the stiffness properties of board far beyond the capabilities of fiber alone and offers water holdout properties essential to good corrugated box performance. Still further, this invention pertains to improving paperboard materials in general.

In producing a suitable container material for shipping goods, in general, combined corrugated board is employed. It consists of a sheet of linerboard glued to each side of a corrugated medium or fluting. The thus produced material is stamped or cut in a sized blank which is folded into an appropriate box, as it is well known in the art. Numerous patents exist with respect to the production of the container material blanks as well as to the shaping of various corrugated material blanks into suitable receptacles.

The medium or fluting in the container blanks is generally produced from semichemical pulp in order to achieve the desired strength and performance characteristics as demanded by the industry. In the United States the corrugated board requirements have been set at a level which often far exceeds the need; this level has been set, apparently, because the semichemical pulp starting material produces these characteristics and these starting materials, i.e., fluting board, characteristics can most closely be correlated to the performance of the box. However, in Europe and in other countries, and increasingly so in the United States, because of the dearth of utilizable pulping resources, i.e., woodlands, for producing semichemical pulp, and because of water and air pollution problems, the requirements for an acceptable container board have been set at a lower and admittedly minimum average value from those values set in the United States. Hence, other materials can, with difficulty, meet the requirements for producing the corrugated medium suitable for the manufacture of an acceptable box of a specified strength. Nevertheless, the lower requirements which have been set in Europe and other continents have still excluded a number of suitable raw material sources which are available in great quantity for producing corrugated board.

For example, one of the most available sources of material would be mixed waste which consists of newspapers and other waste paper materials of various kinds as book papers, writing papers, magazines and old corrugated boxes. Because of its low strength characteristics which cannot be improved sufficiently in the conventional manner such as by refining, i.e., beating, chemical additives, or employing heavier weights, mixed waste cannot be readily utilized. Thus, as yet, there has been no practical way found to bring up mixed waste to a satisfactory strength as characterized by the tests used in the industry, as the Concora Medium Test (CMT) and Cross Directional Ring Crush Test.

It has now been found that the present invention provides not only a method for improving the strength characteristics of materials heretofore not capable of utilization within the prescribed requirements for producing corrugated medium, but also it has now been found that the newly produced material is of heretofore unachieved characteristics which exceed those possible with virgin semichemical fiber or could not have been achieved by utilizing, as a starting material, waste materials; still further, in usefully employing these new sources of materials, a waste material, i.e., sulfite waste liquor in a modified form is used to achieve this end. As it is well known, sulfite waste liquor is considered by the industry as a major pollution problem.

Thus it has now been found that sulfite waste liquors, if appropriately treated, produce a suitable starting material for improving the characteristics of the corrugated medium and liner whereby the end product achieves and can substantially exceed the characteristics achievable by the use of virgin pulp alone, e.g., semichemical. Additionally, materials which heretofore could not practically produce a suitable starting material for making and using boxes are utilizable, i.e., mixed wastes.

It has further been found that the utilization of the waste sulfite liquor thus not only allows for the disposal of the waste liquor in an especially advantageous manner, but additionally, provides a new source material for producing corrugated box material, thus saving scarce resources, i.e., forest resources.

As it can be appreciated, this two-fold improvement in the utilization of wastes heretofore not capable of utilization and utilization of pollutant materials heretofore being a major pollution problem provides advantages and benefits that will be readily apparent from the further discussion of the invention herein.

At this point, it should also stand in good stead to review the necessity for disposing of sulfite waste material. As it is well known to those skilled in the art, the chemical recovery problems or economic utilization of sulfite waste liquor of the usual calcium base cooking method are far more severe than the recovery of an utilization of sulfate waste liquors or other sulphite waste liquors.

As a consequence, numerous sulfite mills have been closed. Although the present process provides for utilization of the sulfite waste liquor, the amount of the waste liquor which can be utilized is still potentially very great, since the amount of waste liquor solids available equals the sulfite pulp production (4,000,000 tons in 1973 in the U.S.A.)

Quantities necessary for upgrading of board does not, however, preclude the use of the herein modified sulfite waste liquor for other applications which the illustrated invention readily suggests, as flake board impregnation, solid fiber-clip board or other fiberous packaging materials, coloring, and sizing.

In general, the corrugated board is characterized by the Concora (CMT) and the Cross Directional Ring Crush tests. As the quality of the container material, i.e., the corrugated board material does fairly correspond to the source material, the ready comparison with prior art and the prior art standard is readily available. Thus, in the United States, the semichemical medium having short, stiff fibers is easily the best comparison. A 127 gram per 1 square meter medium will meet a Concora test, i.e., CMT-60 test of 25–28 kilograms per 100 grams when tested after exposure to controlled climatic conditions of 20° C.—65% relative humidity for sixty minutes.

Boxes made with semichemical corrugated medium and kraft-linerboard naturally provide a source of material useable for corrugated medium and have the best value, i.e., for selected new corrugated box clippings; for these, a Concora test value is of about 14 kilograms per 100 grams/square meter of sheet material. However, old corrugated box material will only be 10–11 kilograms per 100 grams and mixed waste 8–9 kilograms by the Concora test. In order to improve the value when these wastes have been utilized for producing corrugated medium, it has been conventional in the art to add starch or other chemical additives to the fiber material. For example, starch is added either as high viscosity-unmodified starch or as low viscosity-highly modified starch to improve the Concora either by addition to the wet stock or pulp or by size operations. A low viscosity starch adds 120 kilograms CMT per 100 grams of starch added per square meter and 150 kilograms CMT for the high viscosity starch.

However, starch usage is limited by the fact that when used with corrugated board waste or mixed waste, an excessive addition drastically impairs flexibility and leads to unacceptable brittleness.

In the normal range of medium weights (112–135 gr/square meter) the maximum amount that can be economically and practically applied per square meter of board, because of viscosity and penetration of the fiber sheet limitations, is at maximum concentrations of 15 percent for low viscosity and 8 percent for high viscosity starch producing an application of 10 grams/-square meter for low viscosity starch and 6 grams/-square meter for high viscosity starch. Additions of starch are generally at the size press, although 5 grams per square meter of board can be applied in the wet pulp stock with results that are not as effective as when applied at the size press.

As a result, the maximum effective improvement in CMT by starch addition to the base fiber, i.e., CMT at normal running basis weight (112–135 grams per square meter), is 9.0 kilograms for high molecular weight starch and 12.0 kilograms for low molecular weight starch.

With respect to the present invention, it has now been found that if the waste liquor is treated (as further described herein below) and is added to a corrugated medium formed of virgin semichemical pulp, corrugated clippings, old corrugated, or mixed waste material such as No. 2 waste, it can be added in a range from 5 to 30 percent without drastically affecting the flexibility or producing brittleness in the board. At a basis weight level of 125 grams per square meter, 9 to 11 grams per square meter addition to mixed waste will increase the CMT test in a range from 11 to 21 kilograms; the increase in CMT will be from 14 to 25 kilograms for old corrugated boxes, from 18 to 28 kilograms for corrugated board clippings, and from 25 to 35 kilograms for semichemical medium.

Upper limits of practical application at a total basis weight of 125 grams are 25 grams per square meter for semichemical medium and that made from new corrugated board clippings, 18 grams per square meter for old corrugated boxes, and 10 grams per square meter for mixed waste. This maximum effect would improve the measured values, in kilograms, of CMT as follows:

| | From | To |
|---|---|---|
| Mixed waste | 11 kilos | 22 kilos |
| Old corrugated | 14 kilos | 32 kilos |
| Corrugated clippings | 18 kilos | 40 kilos |
| Semichemical board | 25 kilos | 48 kilos |

The modified sulfite waste liquor is an aqueous solution and can be applied at a concentration as high as 50 percent; or it is readily dilutable to 10 percent or lower, e.g., 1 percent or as dilute as practical application might require.

It can be applied to a wet (35 to 45 percent B.D.) sheet or dry sheet (7 to 10 percent moisture). It exhibits neither sticking nor cleanup problems when applied in normal fashion at the paper machine, size press or corrugator, nor when applied to a wet sheet by using the third or second wet press unit as an applicator or spraying at the third press or at intermediate places in the dryers with roll applicators.

Needless to say, if application is made at the wet press as opposed to size press application, the drying requirements on a paper machine is also drastically reduced, placing less demand on steam and as a consequence the paper machine can usually be operated at a much higher efficiency and speed. At the size press the higher concentration permits either higher additions of solids than starch or less water, thus increasing the drying capacity and speed of the paper machine.

Inasmuch as the soluble waste liquor further defined herein provides the ability to run the machine without sticking, i.e., such as at the third press, and subsequently into the dryers, the ability to utilize more efficiently the paper machine and improve its flexibility in operations is further evident.

It is also known that in order to develop the acceptable Concora test, the waste paper pulp must be beaten, i.e., be refined, which is also an expensive operation, but more importantly due to increased drainage time required slows the paper machine down 15 to 20 percent. The waste paper and corrugated waste clippings generally has a Schopper-Riegler value of 18° to 25°. To develop the acceptable Concora the Schopper-Riegler values must be raised by refining to 40° to 45°. These values can also be expressed in corresponding Canadian Standard Freeness. As it is manifestly evident from the above values, the improvement based on this factor is also significant.

In general, waste refining in Europe and elsewhere is carried out by disc refining of the waste material. Refining in general improves the Concora test results by about 3 kilograms per 100 grams basis weight. However, refining is an expensive operation limiting machine capacity and therefore, when the machine operates without a size press, a combination of refining and starch addition to the wet stock is used in order to give the desired end result of 20 kilograms Concora test. Thus, with a 120 to 130 gram sheet it is generally an accepted practice to gain the strength by refining and starch addition to the point where 19 to 21 kilograms of CMT is achieved. Typically, thus, it would require beating and about 3–4 percent starch addition. Beating/refining, of course, as mentioned before descreases machine capacity and starch addition similarly decreases machine capacity reducing drainage capacity of the wire.

Turning now to the present invention, it is evident that if to a 112 gram sheet made from old corrugated waste 15 percent liquor is added, that is, about 18 grams, a sheet of 130 grams is obtained with a CMT value of about 31.5 kilograms. This is equivalent to a sheet of 150 grams American semichemical medium. Needless to say, when, to the waste sheet, this amount of waste liquor is added and the results obtained are of such dimension, the waste material can then be readily substituted for virgin stock used in American semichemical pulp. It is evident that in the most severe conditions, the present invention competes directly with virgin stock.

It is common practice in both Europe and the U.S.A. to make waste paper medium at higher than normal weights to compensate for weak fibers. In Europe it is common practice to run as high as 180 to 200 grams per square meter compared to the conventional level of 112 to 130 grams for semichemical pulp.

This invention permits the elimination of these excessively high weights and further permits the lowering of semichemical board weight in the U.S. from its present standard of 127 grams per square meter to the conventional level in Europe of 112 grams without reducing box performance.

Turning now to the worst available fiber source, i.e., mixed wastes, these are comparably improved such that the properties are brought up to a value where mixed wastes can find employment heretofore not possible, because the industry standards could not be met.

With respect to water holdout, it has also been found that the novel products and methods provide for considerable improvement in the water holdout such as characterized by the one minute Cobb sizing test. Normal linerboard by this test shows water absorption of about 25 to 50 grams per square meter. The normal fluting material, such as made from semichemical pulp, however, has an absorption value of over 200 grams per square meter. The novel product changes this value from 40 to 80 grams per square meter per minute as desired. It is readily apparent, that this change provides for benefits heretofore not achievable with the conventional technology such as the combining of materials at the corrugator with materials providing the desired properties. Accordingly, the utilization of high compressive strength corrugated boxes in high humidity conditions is now possible while at the same time the pollution and the expensive impregnating operation with wax or other petrochemical derivatives has been avoided.

Additionally, the sizing (water holdout) effect can be used by impregnation or surface sizing with a modified sulfite liquor to size (as well as color) linerboard made from waste papers or conventional pulps.

It is, however, known that the various tests mentioned above are first order approximations to establish the necessary values for the starting material. The test which most closely reflects the improvements or the actual performance of the box material is the so-called cross directional ring crush test or CDR test. As it is well known to those skilled in the art, the CDR test has been established as a direct correspondence to the ability of a box to withstand compression loads in actual use. Thus, with the normal linerboard material and semichemical or waste paper corrugating medium, it will have a 10 to 15 kilogram CDR test value for the above defined 110 to 125 sheet. If this sheet, however, is improved as described above by the addition of the modified sulfite waste liquor it can have a target value of 20 kilograms by the CDR test; generally a value from 9 to 12 kilograms is achievable for a 110 to 125 gram sheet. The same factor of improvement applied also to linerboard impregnated or coated with the modified sulfite waste liquor and permits the reduction in basis weight of the linerboard where compression strength is the critical requirement.

With respect to the novel process preparing the liquor used in the linerboard material and the corrugated medium, and the sulfite waste liquor which is used as a starting material to improve the materials is at a pH of 2 to 3 when it is separated from the pulp and concentrated by evaporation to 45 to 50 percent solids concentration.

The basic concept in this novel process is to neutralize properly to a pH of 6.5 to 8.0 the evaporated sulfite waste liquor; and, by further modification with coagulants or reacidification, in which the pH is adjusted to 5.0 to 6.0 and thus intensifies the initial ability of the neutralized waste liquor, to improve paperboard strength qualities. The waste liquor has often been neutralized by caustic (NaOH), in the past, during the evaporation process; and patents describe the use of such neutralized waste liquors. Sodium hydroxide cannot be used in the present process for achieving the results described above. When neutralized with sodium hydroxide before, during, or after evaporation, the material displays little, if any, effect in increasing CMT, ring crush or sizing capability.

However, it has been found that sodium borate ($Na_2BO_3$) provides one neutralization medium which renders sulfite waste liquor capable of imparting increased stiffness and sizing to board. A substantially better and therefore the preferred neutralization agent is sodium aluminate, that is, $Na_2AlO_3$, and also the mixtures of the two, that is, $Na_2AlO_3$ and $Na_2BO_3$, although the use of these two neutralizing agents does not preclude the use of other alkaline chemicals which produce the coagulating and/or stiffening effect. For example, other alkaline, i.e., neutralizing agents which upon neutralization will have an effect such as sodium borate may characterize the useful alkaline agents employable in the products and process of this invention.

After the neutralization of the sulfite waste liquor to pH of 6.5 to 8.0, preferably 6.8 to 7.5, it can then be reacidified to a pH of 5 to 6 with alum, i.e., $Al_2(SO_4)_3$.

The final concentration of solids in the modified waste liquor can be as high as 50 percent and is infinitely dilutable with water.

At the wet presses, i.e., sprayed on or applied by the wet press rolls, the liquor can be applied at a concentration of 50 percent to the wet fiber sheet which is normally 50 to 45 percent bone dry (B.D.).

Since it is readily diluted by water, it can be applied by spraying or coated at the size press at low solid concentrations such as 12 percent which provide an 18 gram per square meter impregnation.

In combination with the initial neutralization, it has also been found very useful and desirable that polymers of ethylene oxide be added to the sulfite waste liquor. Generally, from 0.25 grams up to 3 grams per 100 grams of waste liquor is added and the preferred range is from 1 to 1.5 grams per 100 grams. The ethylene oxide polymer used is a coagulant grade of high molecular weight, i.e., 4,000,000 to 6,000,000 m.w. and it is added in sufficient amount to avoid precipitation of the liqnin component in waste liquors.

Ethylene oxide polymers can also be added to the reacidified waste liquor to improve flow properties and intensify or change other effects such as increased rigity and reduce water holdout.

Inasmuch as the initial addition of sodium borate or aluminate is used for neutralization, the pH measurement provides the necessary amount for the addition.

After neutralization, or the subsequent reacidification of the sulfite waste liquor, as previously explained, with alum, the temperature can be raised to about 80° C. without affecting the ability to spray or coat the liquor (however, it will increase its rate and quality of penetration into the fiber web).

As it is also well known, the Mullen values for the waste, that is, corrugated boxes or clippings, is fairly low and therefore starch is often added to obtain the necessary value for a linerboard, that is, to obtain an increase in Mullen value.

Additionally, with respect to linerboard, it generally requires a specific Cobb value and specific treatment such as the addition of size to obtain the correct sizing. When coating in the normal way with starch to improve Mullen values, this offers some problems since the conventional sizing materials require relatively low temperatures and a low pH (4.5 to 5.5) which in turn reduces the Mullen raising effect of the starch by 20 to 30 percent.

Optimum pH at which starch is applied is at pH 7 to 7.5 and optimum temperature is 75°-80° C. Fortified and synthetic sizes cannot be made effective above pH 6.0 or above 60° C.

In accordance with a novel process, starch can be applied to the linerboard with the waste liquor at the neutralized sodium aluminate state, that is, neutralized stage without addition of ethylene oxide or alum and it will give a satisfactory sizing effect without reducing the effectiveness of the starch in improving the Mullen values. Further the penetration and types of starch used can be improved because temperatures can be held at 75° to 80° C. Thus 3 percent by weight of starch added at the size press will give a satisfactory size value such as Cobb 40. Moreover, since the liquor is at the basic kraft color of pulp, a satisfactory color is imparted to the waste sheet avoiding expensive synthetic colors while the ability to apply more starch or starch more effectively is also evident. Thus, the improved efficiency of starch is a side benefit, that is, because operation can now be carried out at a pH value of about 7 and inasmuch as the waste liquor can be added at 75° to 80° C., the starch is also added at a higher efficiency level.

The evident savings of the fibers is fairly demonstrated from the above. Based on the economics of the waste material and starch material, the ready addition of the modified sulfite waste liquor can provide for the necessary strength and sizing for the linerboard to make it competitive in these respects to linerboard made from virgin fiber, or alternatively to raise the levels of CDRC beyond that possible with virgin fiber.

It is also noted that the modified sulfite material stays substantially with the fiber during subsequent recycling of waste. That is, the sulfite liquor treated as defined above, stays with fiber, is readily recyclable and when the subsequent waste is recycled, it can be laid down again with the attendant advantages.

Inasmuch as normal paper making chemicals are involved and inasmuch as normal operating procedures are employed, changes necessary to be made at any of the operating equipment are minimal and thus the process can be readily practiced on available equipment with a minimum of capital inventment.

The foregoing description of the invention and its illustration is further amplified by the respective embodiments in the examples, which however, should not be construed as a limitation of the broader concept, but merely illustrative of the same.

GENERAL EXAMPLE

It is well known that various processes exist that produce sulphite waste liquor which is dependent on the base used to manufacture the cooking liquor, i.e., calcium, sodium, ammonium and magnesium. Additionally, the type of wood cooked, i.e., softwood or hardwood adds further variables. For reasons of economy and reasons of effectiveness and flexibility in modification for producing strength (CMT) improvements, liquor derived from calcium based cooking of hardwoods has been determined as the best for promotion in the industry. Moreover, hardwood sulfite liquor such as derived from beech wood is the preferred liquor.

Waste liquor is usually evaporated to a 50 to 55 percent solids concentration at which point it can support combustion. In the interest of economy in freight and handling and to provide the high concentrations necessary for applications at the wet press or to the paperboard in dried form, it is desirable that the starting point be at this concentration, i.e., 50 to 55 percent. This does not, however rule out the use of more dilute waste liquor down to 10 to 15 percent concentration at which point the evaporation process is started.

The concentrated waste liquor is modified first by neutralizing with the required amount of dissolved alkaline material, sodium aluminate, sodium borate and/or a combination of either or with a functional equivalent of sodium borate or any of the foregoing with sodium hydroxide, the last up to 25 percent of the total alkali required. Generally less than 25 percent by weight on basis of total solids is the added material including reacidification chemicals, e.g., alum. The liquor is neutralized to a pH of 6.5 to 8.0, preferably 6.8 to 7.5.

The effect of the alkaline agent is to provide reversible coagulating effect of the resinous materials in the liquor and subsequent redispersing of the resinous material as well as subsequent stiffening of the impregnated fibrous material when dried. Sodium borate and sodium aluminate display the above described reversible coagulating effect, but sodium hydroxide does not; hence, alkaline materials which are functionally equivalent to at least sodium borate are suitable. The characteristics of the waste liquor will determine which amount of alkali is required with the range being 4 to 12 percent of the waste liquor solids.

Typical formulations with either reacification or the addition of ethylene oxide polymer are as follows:

| | | | | |
|---|---|---|---|---|
| A. | 100 liters | sulphite waste liquor (calcium base, beech wood liquor) | at 50% = | 50 kgs |
| | | Sodium aluminate sufficient to neutralize, e. g., to a pH of | | |

-continued

| | | | | |
|---|---|---|---|---|
| | | 6.9 to 4.1, e. g., | | 6 kgs |
| | | Aluminum sulphate to reacidify, e. g., to a pH of 4.5 to 5.5, e. g., | | 9 kgs |
| B. | 100 liters | sulphite waste liquor | at 50% = | 50 kgs |
| | | Sodium hydroxide | | 1.5 kgs |
| | | Sodium aluminate | | 3.0 kgs |
| | | Aluminum sulphate | | 9.0 kgs |
| | | (neutralize and reacidify as in A.) | | |
| C. | 100 liters | sulphite waste liquor | at 50% = | 50 kgs |
| | | Sodium aluminate | | 3 kgs |
| | | Sodium borate | | 7 kgs |
| | | Aluminum sulphate | | 9 kgs |
| | | (neutralize and reacidify as in A.) | | |
| D. | 100 liters | sulphite waste liquor | at 50% = | 50 kgs |
| | | Sodium aluminate | | 6 kgs |
| | | Polyethylene oxide | | 0.3 kgs |
| | | (neutralize as in A.) | | |

Application of the modified sulphite waste liquor can be made to any fiber base, i.e., mixed waste, old corrugated boxes, corrugated clippings, straw and straw-waste, bagasse and bagasse-waste and semichemical pulp. The amount that can be applied is limited only by the basic tear and tensile strength of the fibers involved and as it performs on the corrugation.

On this basis, mixed waste can be upgraded to the standard requirements of the European market, i.e., 21 kgs CMT and old corrugated boxes to that required in the U.S. market, i.e., 25 to 28 kgs CMT. Better base material such as semichemical pulp can be upgraded to 40 to 45 kgs CMT and 20 to 25 kgs CDRC.

Following are specific test results on various fiber bases and waste liquor formulations:

| Basis Weight Grams | Liquor Solids Added Grams | CMT 30 kilogrs. | Cross Dir. Ring kilos | Cobb Size |
|---|---|---|---|---|
| AA Mixed waste fiber base - liquor formulation A (as above) | | | | |
| 115 | None-Control | 9.8 | 6.7 | 200+ |
| 115 | 10 | 21.0 | 15.0 | 60 |
| BB Mixed Waste Fiber base - liquor formulation D (as above) | | | | |
| 115 | None-Control | 9.8 | 6.7 | 200+ |
| 115 | 16 | 22.3 | 12.3 | 80 |
| CC Old Corrugated Box - Fiber Base - Liquor Formulation A | | | | |
| 116 | None-Control | 17.5 | 10.0 | 200+ |
| 116 | 16 | 31.6 | 20.0 | 60 |
| DD Semichemical - Fiber Base - Liquor Formulation A | | | | |
| 138 | None-Control | 28.8 | 19.4 | 200+ |
| 138 | 27 | 44.5 | 31.3 | 50 |

Fiber strength and ultimately its formation as paperboard as defined and used herein is characterized by the test factors of Mullen, Concora and Cross Directional Ring Crush. Comparative values for various sources of fiber as board without additives are as follows for a 125 gram per square meter sheet:

| Fiber Source | Mullen $kg/cm^2$ | Concora kgs | C. D. Ring Crush kgs |
|---|---|---|---|
| Mixed Waste | 1.5 | 10.5 | 8.0 |
| Old Corrugated Box Waste | 2.4 | 14.1 | 10.5 |
| New Corrugated Waste | 3.3 | 18.0 | 12.7 |
| Semi Chemical Board | 4.1 | 25.6 | 15.0 |

Concora improvement factor for neutralized sulphite waste liquor lies in the range of 65–75 kgs per 100 grams of sulphite waste liquor solids added per square meter. When a coagulant such as ethylene oxide polymer is added or reacidification is made with alum, the improvement effect rises to 110 kilograms.

For the purpose of increasing Mullen only and without reference to bonding or sizing qualities the following is pertinent to starch application to medium and linerboard.

High viscosity starches, usually unmodified or slightly oxidized or hydrolized corn starch are characterized as continuously cooked starches made up and applied at a concentration of 4–8% with a Baume of 0.5°–3.0°. These starches display serious retrogression or gelling on cooling.

Low viscosity starches, oxidized, hydrolized or enzyme converted, derived from corn or potato starch and applied normally in a concentration of 6–18% with a Baume of 1.0°–8.0°; these starches can be batch cooked and held without serious retrogression or gelling on cooling.

Application temperatures of starches can match paper temperature at the machine (85° C.) but due to normally used additives are kept below 65° C.

Various sizes may also be applied (surface sizing) to the sheet materials described above. These are conventional rosin sizes or synthetic sizes available on the market such as Baysyntol size from Bayer Co. Other examples are stearates, waxes, etc.; these sizes should not precipitate upon acidification as does sodium resinate. Useful sizes as well as starches (incorporated by reference herein) are disclosed in Casey, Pulp and Paper, Vol. II, 2nd Ed., Interscience Publishers, Inc., New York (1961).

In general, the sheet material at the size press is 75 to 85% dry (B.D. basis); at the dryer section 60%, but more conventionally 70% (B.D. basis). In the wet presses, the sheet material is 35% to 45% dry (B.D. basis).

Although, the above described sulfite liquor is calcium base liquor, the invention also pertains to magnesium, ammonium or sodium base sulfite liquors.

Testing

All testing referred to herein relates to results obtained after conditioning for one hour at 20° C. and 65% (percent) relative humidity which constitutes European standards for paper testing.

The "Concora" or "Concora Medium Test" (CMT) is defined in TAPPI Method T-809 and DIN 53143 with results expressed in absolute kilograms for the sample tested.

The "Cross Directional Ring Crush" test (CDRC) is defined in TAPPI Method T-472 with results expressed in absolute kilograms for the sample tested.

The significant effect of refining on fiber is to change its rate of water drainage. The change is measured by the Canadian Standard Freeness Tester and in Europe by the Schopper Riegler Test both of which measure the drainage rate factor and its implied relation to the amount of fiber refining. Comparative test values are as follows:

| Canadian Standard | Schopper Riegler |
|---|---|
| 600 | 20.0 |
| 500 | 25.3 |
| 400 | 32.0 |
| 300 | 40.3 |
| 200 | 51.5 |

The "Cobb Size" test is a measure of water penetration into sized paper. A conditioned, weighed board specimen is normally covered by an 11.3 cm diameter open metal ring into which 100 millimiters of water at 20° C. is poured. At the end of 45 seconds the water is poured off, the sheet blotted from excess moisture and immediately weighed. Each water absorption of 0.01 grams is multiplied by 100 and results expressed as grams absorbed per square meter.

Mullen or bursting strength is the hydrostatic pressure measured in pounds or kilograms required to rupture a circular area of paper or paperboard approximately 1.13 square inches in area. Testing method is referred to in TAPPI T 403 or DIN 53141.

Although the general discussion above has been about the preferred corrugated medium or linerboard, the container, structural sheet, construction material, etc. uses of the modified fibrous materials are within the scope of the invention. Similarly, the increasingly employed hexcell structural fillers can be made from the above defined fibrous source materials with outstanding results.

Hence, the various equivalents, alternatives, and applications thereof, will readily suggest themselves to those employing the fibrous cellulosic materials for same or other purposes.

What is claimed is:

1. An article of manufacture comprising a cellulosic fibrous sheet material having incorporated therein, at the wet press or size press, from about 5 to 30 percent by weight of waste sulfite liquor, which liquor has been neutralized to a pH of about 6.5 to 8.0 with sodium aluminate prior to addition to said sheet material.

2. The article of manufacture as defined in claim 1 wherein said waste sulfite liquor is reacidified after neutralization but prior to addition to said sheet material to a pH of 4 to 6.

3. As an article of manufacture, a dried cellulosic corrugated medium, including waste fiber material, to which has been added at the wet press or size press from about 5 to 30 percent by weight of waste sulfite liquor, said waste liquor having been neutralized prior to addition to said medium to a pH of about 6.5 to 8.0 with sodium aluminate, said waste liquor having further been reacidified prior to addition to said medium to a pH of 5 to 6 with alum and wherein ethylene oxide polymer is added thereto in an amount from about 0.25 to 3 grams per 100 grams of waste liquor at 45 to 50 percent solids concentration.

4. The article of manufacture as defined in claim 3, wherein the waste fiber is corrugated box clippings.

5. The article of manufacture as defined in claim 3, wherein the waste fiber material is mixed waste fiber.

6. The article of manufacture as defined in claim 3, wherein the medium is semi-chemical pulp.

7. The article of manufacture as defined in claim 3, wherein the waste fiber material is No. 2 waste fiber.

8. As an article of manufacture, a cellulosic fibrous sheet material having incorporated therein at the wet press or size press from about 5 to 30 percent by weight of waste sulfite liquor, which liquor has been neutralized to a pH of about 6.5 to 8.0 with sodium aluminate prior to addition to said sheet material and wherein said waste liquor includes polyethylene oxide.

9. The article of manufacture as defined in claim 8, wherein said waste liquor is reacidified to a pH of 4 to 6 with alum.

10. As an article of manufacture, a dried cellulosic corrugated medium having incorporated therein at the wet press or size press from about 5 to 30 percent by weight of waste sulfite liquor which liquor has been neutralized to a pH of about 6.5 to 8.0 with sodium aluminate, and reacidified to a pH of 4 to 6 with alum prior to addition to said medium.

11. The article of manufacture as defined in claim 10, wherein ethylene oxide polymer is added to said neutralized sulfite liquor.

12. As an article of manufacture, a dried cellulosic corrugated medium, including waste fiber material, to which has been added at the wet press or size press from about 5 to 30 percent by weight of waste sulfite liquor, said waste liquor having been neutralized prior to addition to said medium to a pH of about 6.5 to 8.0 with sodium aluminate and wherein ethylene oxide polymer is added to said waste liquor in an amount from about 0.25 to 3 grams per 100 grams of waste liquor at 45 to 50 percent solids concentration.

13. The article of manufacture as defined in claim 12, wherein the waste fiber is corrugated box clippings.

14. The article of manufacture as defined in claim 12, where the waste fiber material is mixed waste fiber.

15. The article of manufacture as defined in claim 12, wherein the medium comprises semi-chemical pulp.

16. The article of manufacture as defined in claim 12, wherein the waste fiber material is No. 2 waste fiber.

17. As an article of manufacture, a corrugated medium comprising cellulose fibers including waste fibers and from about 5 to 30 percent by weight of waste sulfite liquor which has been neutralized to a pH of about 6.5 to 8.0 with sodium aluminate and reacidified with alum prior to addition to said medium at the wet press or size press.

18. As a cellulosic fibrous sheet material, a corrugated medium and a linerboard material having incorporated therein at the wet press or size press from about 5 to 30 percent by weight of waste sulfite liquor, said waste sulfite liquor having been neutralized with sodium aluminate to a pH of 6.5 to 8, and reacidified with alum prior to addition to said medium.

19. The sheet material as defined in claim 18, wherein starch is also incorporated in said sheet material.

20. The sheet material as defined in claim 18, wherein a sizing agent is incorporated in the sheet material.

21. The article of manufacture as defined in claim 18, wherein the linerboard comprises the waste sulfite liquor and starch and starch is added in the amount of from 1 to 5 percent by weight of a 100 to 450 gram sheet of 1 square meter.

22. The linerboard material as defined in claim 18, wherein said waste sulfite liquor is a softwood or hardwood sulfite liquor.

* * * * *

UNITED STATES PATENT AND TRADEMARK OFFICE

CERTIFICATE OF CORRECTION

PATENT NO. : 4,191,610

DATED : March 4, 1980

INVENTOR(S) : Eric S. Prior

It is certified that error appears in the above—identified patent and that said Letters Patent is hereby corrected as shown below:

Column 9, in the table at the top of the page, delete "4.1" and substitute therefor --7.1--.

Signed and Sealed this

*Twenty-sixth* Day of *August 1980*

[SEAL]

*Attest:*

SIDNEY A. DIAMOND

*Attesting Officer*

*Commissioner of Patents and Trademarks*